US009829198B2

(12) United States Patent
Stastny et al.

(10) Patent No.: US 9,829,198 B2
(45) Date of Patent: Nov. 28, 2017

(54) COMBUSTOR FLOATING COLLAR ASSEMBLY

(71) Applicant: PRATT & WHITNEY CANADA CORP., Longueuil (CA)

(72) Inventors: Honza Stastny, Georgetown (CA); Bhawan B. Patel, Mississauga (CA); Ram Kulathu, Mississauga (CA); Sudhakara Reddy Annem, Hyderabad (IN); Balakrishna Gaja, Hyderabad (IN); Bharath Mandya Nagaraj, Mandya (IN)

(73) Assignee: PRATT & WHITNEY CANADA CORP., Longueuil (CA)

( * ) Notice: Subject to any disclaimer, the term of this patent is extended or adjusted under 35 U.S.C. 154(b) by 630 days.

(21) Appl. No.: 13/964,378

(22) Filed: Aug. 12, 2013

(65) Prior Publication Data

US 2015/0040568 A1 Feb. 12, 2015

(51) Int. Cl.

| | |
|---|---|
| ***F23R 3/00*** | (2006.01) |
| *F23R 3/28* | (2006.01) |
| *F23R 3/60* | (2006.01) |

(52) U.S. Cl.

CPC ..... *F23R 3/002* (2013.01); *F23R 3/283* (2013.01); *F23R 3/60* (2013.01); *F23R 2900/00012* (2013.01); *F23R 2900/00017* (2013.01)

(58) Field of Classification Search

CPC .. F23R 3/283; F23R 3/60; F23R 2900/00017; F23R 3/00; F23R 3/002; F23R 3/20; F23R 3/286

USPC ..... 60/39.821, 39.827

See application file for complete search history.

(56) References Cited

U.S. PATENT DOCUMENTS

| | | | | |
|---|---|---|---|---|
| 3,311,148 | A | 3/1967 | Leitner | |
| 5,117,624 | A * | 6/1992 | Roberts, Jr. | F23R 3/283 60/740 |
| 6,039,130 | A | 3/2000 | Pruet | |
| 7,347,189 | B2 | 3/2008 | Anello et al. | |
| 7,775,051 | B2 | 8/2010 | Hernandez et al. | |
| 8,015,706 | B2 | 9/2011 | Markarian et al. | |
| 8,104,291 | B2 | 1/2012 | Myers et al. | |
| 8,375,726 | B2 | 2/2013 | Wiebe et al. | |

* cited by examiner

*Primary Examiner* — William H Rodriguez
*Assistant Examiner* — Thomas Burke
(74) *Attorney, Agent, or Firm* — Norton Rose Fulbright Canada LLP

(57) ABSTRACT

A gas turbine combustor floating collar for mounting an igniter or fuel nozzle to a combustor is provided with an outer periphery in a non-circular shape, for example having at least one section thereof formed with a flat surface, such as a square or triangular shape. The outer periphery of the floating collar is complementary to and completely surrounded by an inner periphery surface of a recess of a boss affixed on the combustor, thereby preventing substantial rotation of the floating collar with respect to the boss.

16 Claims, 5 Drawing Sheets

COMBUSTOR FLOATING COLLAR ASSEMBLY

TECHNICAL FIELD

The application relates generally to gas turbine engines, and more particularly, to combustor floating collar assemblies for such engines.

BACKGROUND OF THE ART

Gas turbine combustors are typically provided with floating collar or seal assemblies for mounting igniters or fuel nozzles to the combustor, in order to facilitate relative movement of igniters or fuel nozzles with controlled leakage therebetween during engine operation. This arrangement helps to avoid loading on the igniter or fuel nozzles from the combustor movement. Conventional combustor floating collar assemblies are provided with anti-rotation tabs or brackets to prevent the igniters or fuel nozzles from rotation, while permitting axial and radial/lateral movement with respect to the combustor. Fretting wear of the anti-rotation tabs or brackets occurs in conventional floating collar assemblies due to aerodynamic loading and vibration. This can result in pre-mature removal of engines in the field due to difficulties reinstalling igniters or fuel nozzles during overhaul. A floating collar with worn-out anti-rotation tabs may start rotating and creating grooves in the igniter or fuel nozzle which is secured by the floating collar. Accordingly there is a need to provide a solution which addresses these and other limitations of the conventional floating collar assemblies.

SUMMARY

In one aspect, there is provided a gas turbine combustor including a floating collar assembly, the floating collar assembly comprising: a hollow boss, a passage extending through the boss along an axis between first and second opposed ends of the boss, the first end of the boss affixed to a wall of the gas turbine combustor and the passage communicating with an interior of the combustor, the passage having a portion at the second end with a cross-section normal to the axis which is non-axisymmetric relative to the axis; a floating collar disposed at least partially within the passage, the floating collar having an non-axisymmetric outer periphery selected to be complementary to and received in the non-axisymmetric portion of the passages to anti-rotate the floating collar with respect to the boss relative to the axis, the outer periphery defining a cross-section normal to the axis fully confined within the portion of the passage; and a retainer apparatus axially restraining the floating collar at least partially within the passage.

In another aspect, there is provided a floating collar assembly for a gas turbine combustor comprising: a boss having a central axis and opposed first and second ends, a passage extending through the boss in an axial direction from the first to second end, a boss flange extending outwardly from the second end, a non-axisymmetric peripheral wall extending along an entire outer periphery of the boss flange and projecting axially from the boss flange in a direction away from the first end to form a recess communicating with the passage of the boss, the peripheral wall forming a closed inner peripheral surface; a floating collar having an outer periphery disposed within and laterally surrounded by the peripheral wall and defining a central aperture, the outer periphery including a non-axisymmetric surface mated with the inner peripheral surface of the non-axisymmetric peripheral wall to provide anti-rotation of the floating collar with respect to the boss and the axis; and a cap defining a central aperture axially extending therethrough, the cap being attached to the peripheral wall, the floating collar being restrained within the recess by the peripheral wall and the cap.

DESCRIPTION OF THE DRAWINGS

Reference is now made to the accompanying figures in which.

It will be noted that throughout the appended drawing, like features will be identified by like reference numerals.

DETAILED DESCRIPTION

Figure 1:
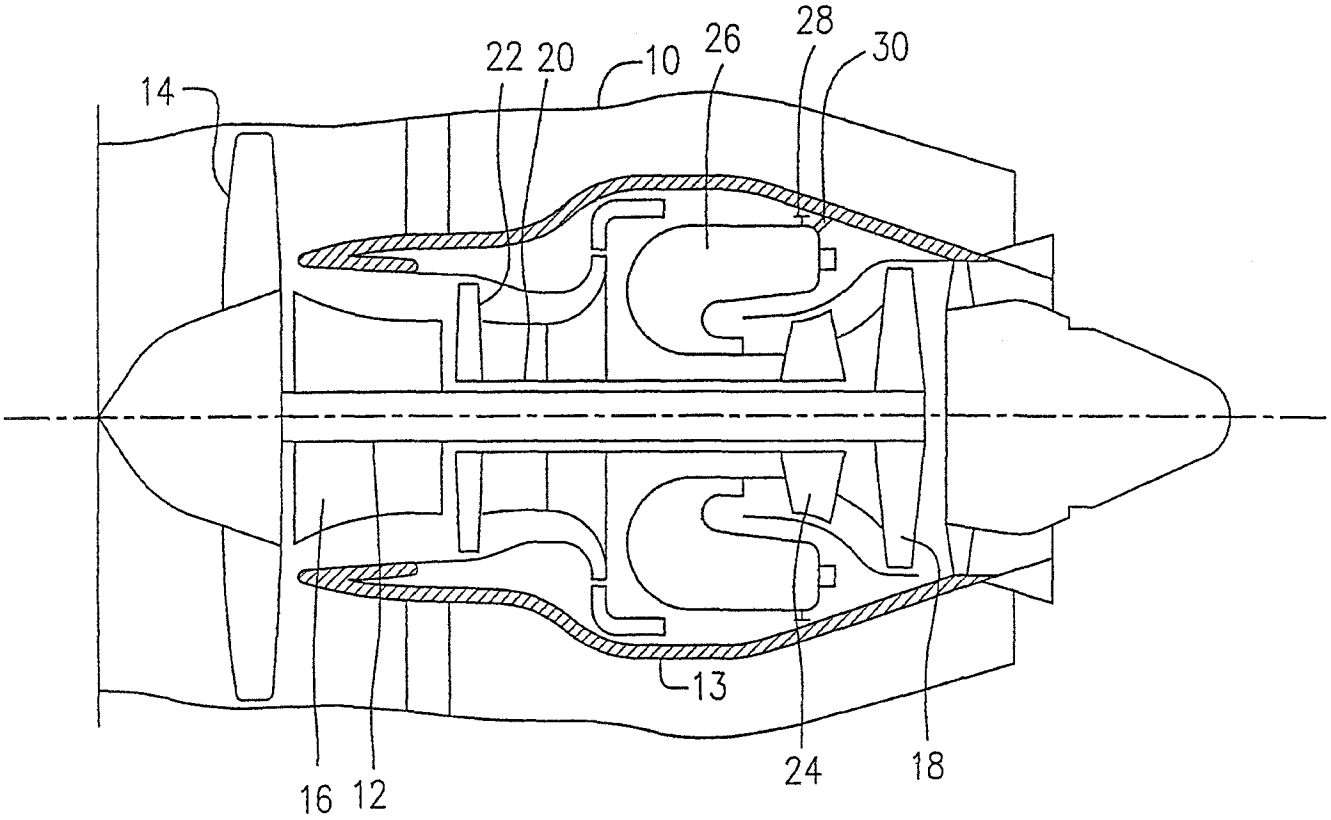
FIG. 1 is a schematic side cross-sectional view of a gas turbine engine.

FIG. 1 illustrates an aircraft turbofan gas turbine engine presented as an example of the application of the described subject matter, including a housing or nacelle 10 including an annular core casing or engine outer case 13, a low pressure spool assembly seen generally at 12 which includes a fan assembly 14, a low pressure compressor assembly 16 and a low pressure turbine assembly 18, and a high pressure spool assembly seen generally at 20 which includes a high pressure compressor assembly 22 and a high pressure turbine assembly 24. The annular outer case 13 surrounds the low and high pressure spool assemblies 12 and 20 in order to define a main fluid path (not numbered) therethrough. A combustor 26 is provided in the main fluid path. A plurality of fuel nozzles 28 and at least one igniter 30 are attached to and extend into the combustor 26.

Referring to FIGS. 2-7, an apparatus 32 includes the igniter 30 (a fuel nozzle 28 as shown in FIG. 1) mounted through a floating collar assembly (not numbered) into an opening 34 defined in a combustor wall 36 which is part of the combustor 26 of FIG. 1. The floating collar assembly may include a hollow boss member 38, a floating collar 40 and a cap 42.

It should be noted that the apparatus 32 is applicable to both igniters and fuel nozzles and therefore, the igniter 30 described hereinafter may be replaced by the fuel nozzle 28.

In accordance with one embodiment, the hollow boss member 38 may define a central axis 44 and may have opposed ends 46, 48. A passage 50 may extend along its axis through the boss member 38 in the direction of the central axis 44 between the ends 46, 48. The passage 50 may have an enlarged portion to form a recess 52 with an inner periphery 54 which defines a closed surface in a non-axisymmetric shape with respect to the central axis 44.

It should be noted that throughout this description, the axial and radial directions are defined respectively with respect to the central axis 44.

Figure 2:
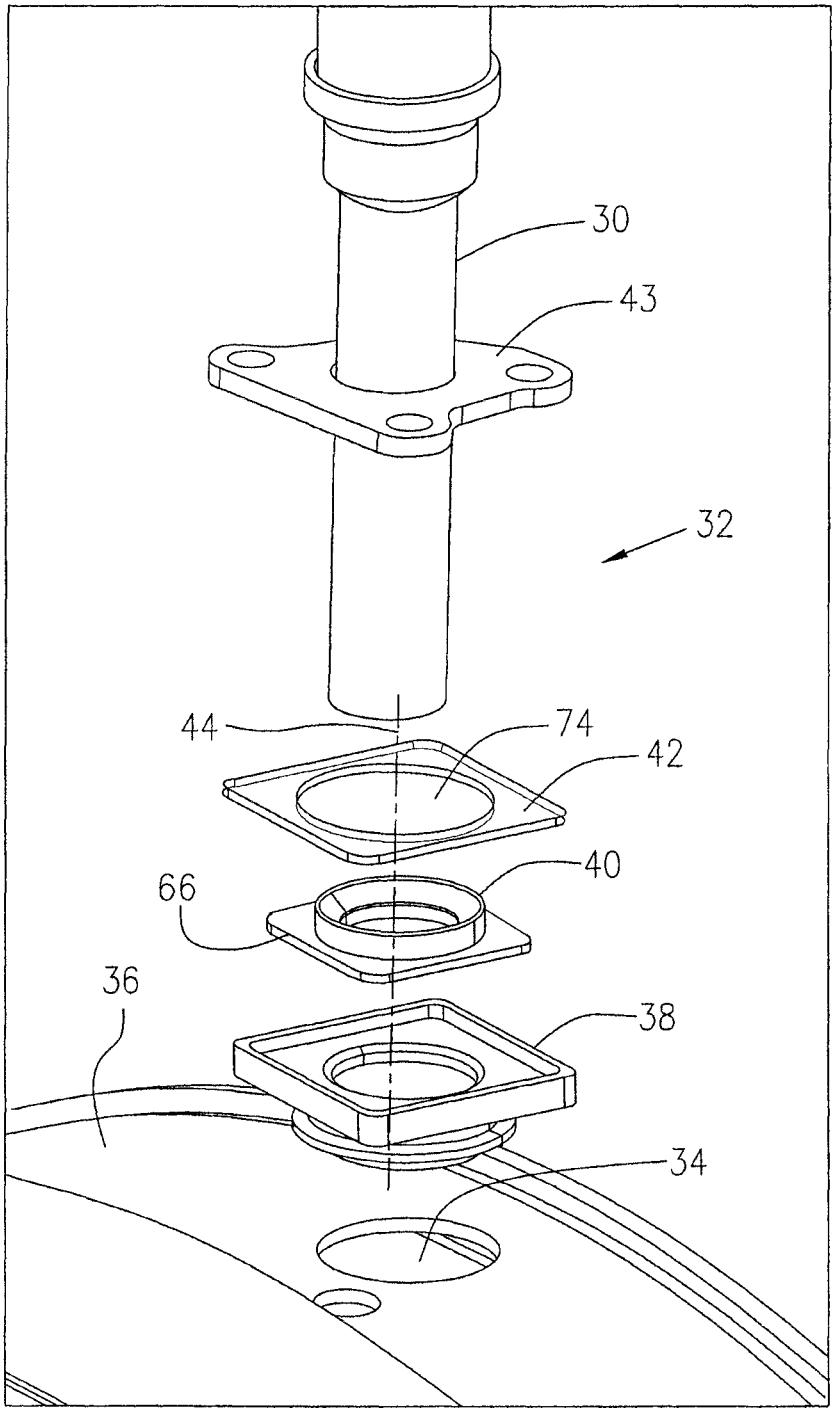
FIG. 2 is an exploded perspective view of a combustor floating collar assembly to be mounted to a combustor of the gas turbine engine shown in FIG. 1, according to one embodiment.
Figure 4:
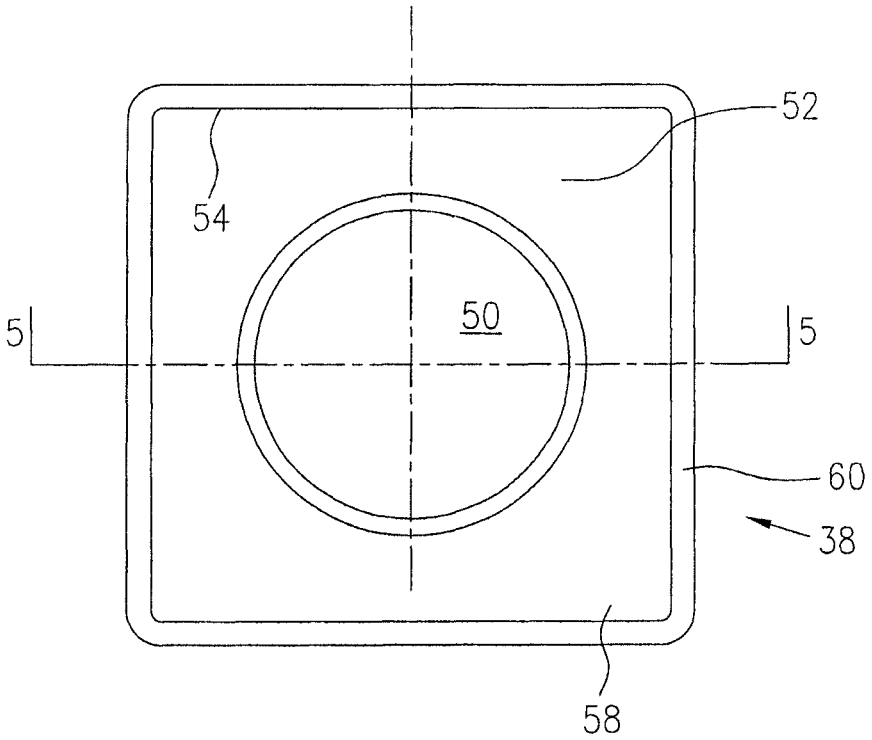
FIG. 4 is a top plan view of a boss member of the combustor floating collar assembly of FIG. 2.
Figure 5:
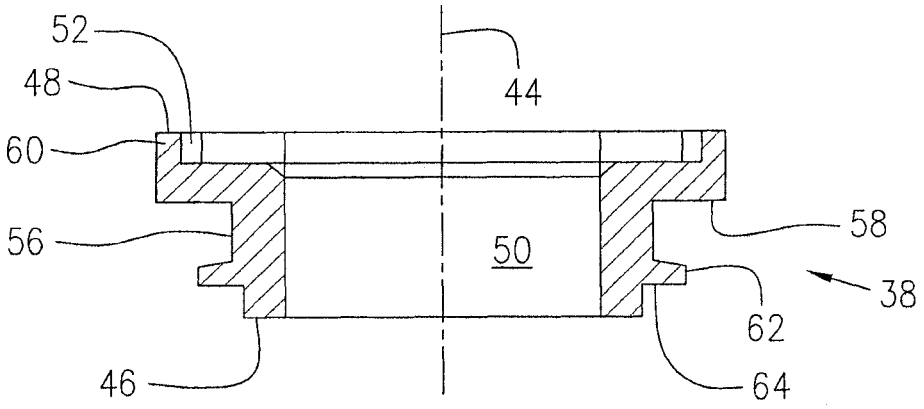
FIG. 5 is a cross-sectional view of the boss member taken along line 5-5 in FIG. 4.
Figure 6:
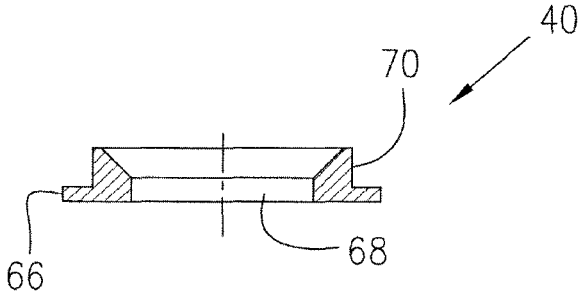
FIG. 6 is a cross-sectional view of the floating collar, taken along line 7-7 in FIG. 7.
Figure 8:
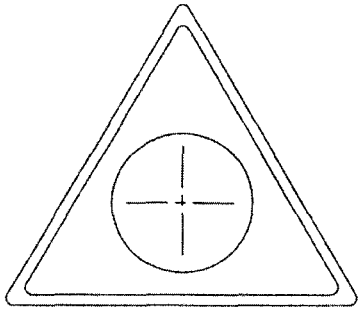
FIG. 8 is a top plan view of a boss member of the combustor floating collar assembly, alternative to that shown in FIG. 4.

In particular, the hollow boss member 38 may include a cylindrical body 56 defining a major section of the passage 50 extending therethrough. One end of the cylindrical body 56 forms the end 46 of the hollow boss member 38 and is affixed, for example by welding to the combustor wall 36, with the passage 50 substantially aligned with the opening 34. At the other end (not numbered) of the cylindrical body 56, a flange 58 extends from the cylindrical body 56 radially and outwardly with respect to the central axis 44. A peripheral wall 60 extends along an entire outer periphery of the flange 58 and projects axially from the flange 58 to thereby form the recess 52 defined within the inner periphery 54. The peripheral wall 60 which also forms the closed surface to define the inner periphery 54 which includes at least one section formed with a flat surface in this example. The peripheral wall 60 or the inner periphery 54 may define, for example a square shape (as shown in FIGS. 2 and 4) or a triangular shape (as shown in FIG. 8).

Optionally, a positioning ring 62 may be provided on the hollow boss member 38, projecting radially outwardly from the cylindrical body 56 to thereby define an annular positioning shoulder 64 between the cylindrical body 56 and the positioning ring 64 at the end 46 of the cylindrical body 56 (also the end of the hollow boss member). The annular positioning shoulder 64 allows the positioning ring 62 to rest on the edge of the opening 34 of the combustor wall 36 while allowing the end 46 of cylindrical body 56 to extend into the opening 34 of the combustor wall 36 for secure attachment of the hollow boss member 38 to the combustor wall 36.

The floating collar 40 has an outer periphery 66 with a non-axisymmetric shape complementary to and being contained within the inner periphery 54 of the recess 52 so that the floating collar is somewhat shielded or protected by the boss to reduce aerodynamic loads caused by air flowing around the combustor. The cap 42 may also provide further shielding or protection to reduce damage from these aerodynamic loads.

In order to allow a body of the igniter 30 to extend through the passage 50 of the hollow boss member 38 into the combustor 28, or to be exposed to a chamber of the combustor 28, when the floating collar 40 snugly surrounds the body of the igniter 30. The outer periphery 66 of the floating collar 40 may include at least one section formed with a flat surface corresponding with and to be mated with the flat surface of the at least one section of the inner periphery 54 of the recess 52 of the hollow boss member 38, thereby preventing substantial rotation of the floating collar 40 with respect to the hollow boss member 38.

In accordance with an embodiment, the floating collar 40 may include a cylindrical body 70 extending radially with respect to the central axis 44 and may define a central aperture 68 which snugly receives the body of the igniter 30. A flange 72 may extend radially outwardly from the cylindrical body 70. The flange 72 may be positioned substantially normal to the central axis 44 and a periphery of the flange 72 may define the outer periphery 66 of the floating collar 38. The outer periphery 66 may be completely surrounded by the peripheral wall 60 of the hollow boss member 38 and at least one section of the outer periphery 66 which is formed with a flat surface, may correspond with and mate with the flat inner surface of the at least one section of the peripheral wall 60 of the hollow boss member 38.

Figure 7:
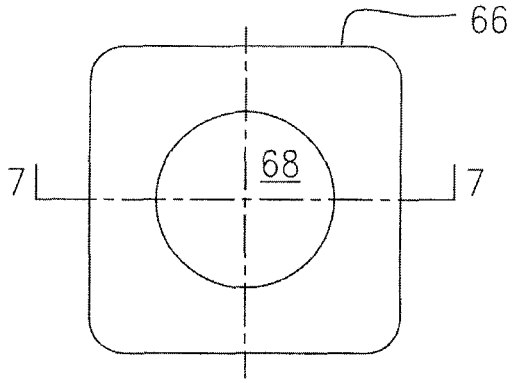
FIG. 7 is a bottom plan view of a floating collar of the combustor floating assembly of FIG. 2.
Figure 9:
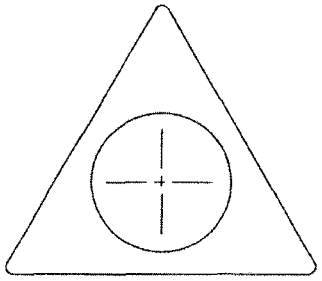
FIG. 9 is a bottom plan view of a floating collar of the combustor floating assembly, alternative to that shown in FIG. 6.

The outer periphery 66 of the floating collar 40 may define a square shape (as shown in FIG. 7) or a triangular shape (as shown in FIG. 9), corresponding to the shape of the peripheral wall 60 (inner periphery 54) of the hollow boss member 38.

The flange 72 of the floating collar 40 may be positioned at one end of the cylindrical body 70 and the other end of the cylindrical body 70 may have a bevelled annular inner surface (not numbered) such that the central aperture 68 formed by the cylindrical body 70 of the floating collar 40 may have an enlarged diameter at the other end of the cylindrical body 70 in order to reduce the annular contact area between the body of the igniter 30 and the floating collar 40 when the body of the igniter 30 is snugly received in the central aperture 68 of the floating collar 40.

Figure 3:
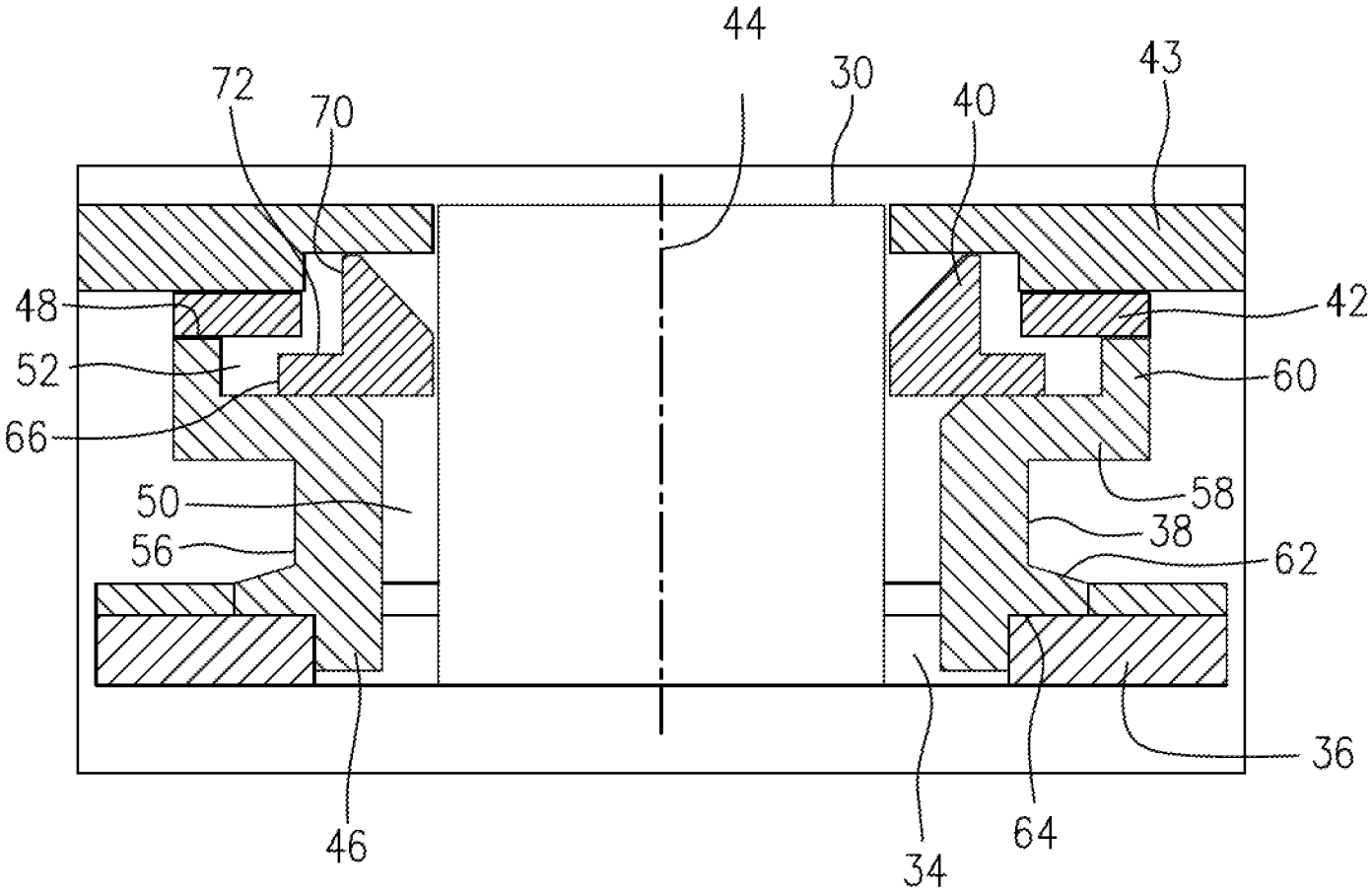
FIG. 3 is a cross-sectional view of the combustor floating collar assembly of FIG. 2.

In accordance with one embodiment, the cap 42 which may be formed by a flat plate, defines a central aperture 74 axially extending therethrough. The cap 42 may be positioned on the peripheral wall 60 which forms the end 48 of the hollow boss member 38, in order to cover the recess 52, such that at least a portion of the floating collar 40 is restrained within the recess 52 by the peripheral wall 60 and the cap 42 with axial and radial tolerances, thereby providing a "floating" function of the floating collar 40 with respect to the hollow boss member (as shown in FIG. 3). For example, the flange 72 of the floating collar 40 may be restrained within the recess 52 with a "floating" capability therein but with no substantial rotation capability with respect to the hollow boss member 38 while allowing the cylindrical body 70 of the floating collar 40 to extend loosely through the central aperture 74 of the plate of the cap 42 and out of the recess 52. The cap 42 may axially restrain the floating collar within the recess 52 with an axial tolerance such as between 0.002 inches and 0.030 inches.

As illustrated in FIG. 3, the body of the igniter 30 which is snugly received in the central aperture 68 of the floating collar 40 extends loosely through the passage 50 of the hollow boss member 38 and the opening 34 of the combustor wall 36 such that the body of the igniter 30 is allowed a small but limited movement together with the floating collar 40 with respect to the combustor wall 36 and the hollow boss member 38 affixed to the combustor wall 36.

It should be noted that the tolerances illustrated in FIG. 3 are exaggerated for convenience of description and clarity of illustration.

The cap 42 may have a shape similar to the shape of the outer peripheral wall 60 of the hollow boss member 38 such as a square or triangle. Nevertheless, the cap 42 may have an outer periphery defining a shape different from the shape defined by the outer peripheral wall 60 of the hollow boss member 38.

In accordance with another possible embodiment, the apparatus may further include a mounting plate 43. The mounting plate 43 may be larger than the cap 42 such that the mounting plate 43 can be positioned on the cap 42 and removably secured to the combustor wall 36 by, for example bolts/screws (not shown). The mounting plate 43 may define an aperture (not numbered) allowing the body of the igniter 30 to extend therethrough while applying mounting forces on the cap 42 which in turn encloses the flange 66 of the floating collar 40 within the recess 52 of the hollow boss member 38.

It will be understood that the cap 42 and the portion of passage with a reduced cross-section relative to the recess co-operate to axially restrain the floating collar in the boss, and thus together provide a retainer apparatus. The cap 42 may be replaced by any suitable device which axially restrains the floating collar outwardly, for example such as a suitable clip (not shown) or other means. Similarly, the change in cross-section in the passage may be replaced by other means to axially restrain the floating collar inwardly, such as a local reduction in cross-section (e.g. a ridge or bump, not shown) or a suitable clip (not shown) or other means.

The above description is meant to be exemplary only, and one skilled in the art will recognize that changes may be made to the embodiments described without departing from the scope of the described subject matter. For example, the inner periphery of the recess of the hollow boss member and the outer periphery of the floating collar may have shapes other than those described in the above-described embodiments. For example, the hollow boss member may have a recess with an inner periphery defining any suitable non-axisymmetric shape. Many options are possible which suitably anti-rotate of the floating collar about the axis with respect to the hollow boss member, such as nut-like hexagonal or other flats, ellipses, to name only a few. Modifications which fall within the scope of the described subject matter will be apparent to those skilled in the art, in light of a review of this disclosure, and such modifications are intended to fall within the appended claims.

The invention claimed is:

1. A gas turbine combustor including a floating collar assembly, the floating collar assembly comprising:

a hollow boss, a passage extending through the boss along an axis between first and second opposed ends of the boss, the first end of the boss affixed to a wall of the gas turbine combustor and the passage communicating with an interior of the combustor, the passage having a portion at the second end with a cross-section normal to the axis which is non-axisymmetric relative to the axis;

a floating collar disposed at least partially within the passage, the floating collar having a non-axisymmetric outer periphery selected to be complementary to and received in the non-axisymmetric portion of the passage to anti-rotate the floating collar with respect to the boss relative to the axis, the outer periphery defining a cross-section normal to the axis fully confined within the portion of the passage;

a retainer apparatus axially restraining the floating collar at least partially within the passage, the retaining apparatus including a cap at least partially covering the second end and a reduced cross-section of the passage disposed between the floating collar and the first end; and a mounting plate positioned on and in contact with the cap and removably secured to the wall of the combustor separately from the floating collar, the mounting plate defining an aperture to allow an igniter or a fuel nozzle to extend therethrough.

2. The apparatus as defined in claim 1 wherein the retainer apparatus includes the cap substantially covering the second end of the boss, the cap having an aperture for receiving the igniter or the fuel nozzle.

3. The apparatus as defined in claim 1 wherein the portion of the passage and the outer periphery of the floating collar, comprise mating flats.

4. The apparatus as defined in claim 1 wherein the cross-section of the portion of the passage and the cross-section of the outer periphery have a rectilinear shape.

5. The apparatus as defined in claim 1 wherein the cross-section of the portion of the passage and cross-section of the outer periphery are square.

6. The apparatus as defined in claim 1 wherein the cross-section of the portion of the passage and the cross-section of outer periphery are triangular.

7. A floating collar assembly for a gas turbine combustor comprising:

a boss having a central axis and opposed first and second ends, a passage extending through the boss in an axial direction from the first to second end, a boss flange extending outwardly from the second end, a non-axisymmetric peripheral wall extending along an entire outer periphery of the boss flange and projecting axially from the boss flange in a direction away from the first end to form a recess communicating with the passage of the boss, the peripheral wall forming a closed inner peripheral surface;

a floating collar having an outer periphery disposed within and laterally surrounded by the peripheral wall and defining a central aperture, the outer periphery including a non-axisymmetric surface mated with the inner peripheral surface of the non-axisymmetric peripheral wall to provide anti-rotation of the floating collar with respect to the boss and the axis; and a cap defining a central aperture axially extending therethrough, the cap being attached to the peripheral wall of the boss, the floating collar being restrained within the recess by the peripheral wall and the cap, and a mounting plate positioned on and in contact with the cap and adapted to be removably secured to a wall of the gas turbine combustor separately from the floating collar, the mounting plate defining an aperture that is substantially aligned with the central aperture of the cap and the central aperture of the floating collar to allow an igniter or a fuel nozzle of the gas turbine combustor to extend through the aperture of the mounting plate, the central aperture of the cap and the central aperture of the floating collar.

8. The floating collar assembly as defined in claim 7 wherein the outer periphery of the floating collar and the peripheral wall of the recess of the boss each define a square shape, respectively.

9. The floating collar assembly as defined in claim 7 wherein the outer periphery of the floating collar and the peripheral wall of the recess of the boss each define a triangular shape, respectively.

10. The floating collar assembly as defined in claim 7 wherein the floating collar comprises a cylindrical body extending axially with respect to the central axis and a floating collar flange extending outwardly from the cylindrical body and being positioned substantially normal with respect to the central axis, a periphery of the flange defining the outer periphery of the floating collar.

11. The floating collar assembly as defined in claim 10 wherein the floating collar flange is restrained with an axial tolerance between the cap and the boss flange, and wherein the cylindrical body of the floating collar extends loosely through the central aperture of the cap.

12. The floating collar assembly as defined in claim 7 wherein the cap comprises a plate defining said central aperture.

13. The floating collar assembly as defined in claim 10 wherein the floating collar flange is positioned at an end of the cylindrical body.

14. The floating collar assembly as defined in claim 7 wherein the boss comprises a positioning ring projecting radially outwardly from the boss with respect to the central axis to thereby define a positioning shoulder between the boss and the positioning ring at the first end of the boss.

15. The apparatus as defined in claim 1, wherein the mounting plate includes holes defined therein, the holes being configured to receive fasteners.

16. The floating collar assembly as defined in claim 7, wherein the mounting plate includes holes defined therein, the holes being configured to receive fasteners is directly connected to the cap.

* * * * *